United States Patent [19]

Gala

[11] 4,356,576

[45] Nov. 2, 1982

[54] FLUSH CONTROL APPARATUS

[76] Inventor: Jerry Gala, 626 King George Rd., Fords, N.J. 08863

[21] Appl. No.: 265,587

[22] Filed: May 20, 1981

[51] Int. Cl.[3] ..... E03D 1/00; A47L 17/00

[52] U.S. Cl. ..... 4/661; 4/324; 4/415

[58] Field of Search ..... 4/415, 324, 378, 405, 4/411, 415, 253, 661, 435; 292/340, 347, 288; 251/284, 285, 286

[56] References Cited

U.S. PATENT DOCUMENTS

| | | | |
|---|---|---|---|
| 3,719,957 | 3/1973 | Riedel | 4/324 X |
| 3,745,591 | 7/1973 | Girten | 4/324 X |
| 4,319,368 | 3/1982 | Peters | 4/661 |

*Primary Examiner*—John W. Shepperd
*Assistant Examiner*—Kenneth S. Putnam
*Attorney, Agent, or Firm*—Arthur L. Plevy

[57] ABSTRACT

A flush control apparatus is adapted to be directly mounted on the front surface of a water storage tank of a commode directly beneath the flush handle of the commode. The apparatus comprises a bracket having a lever pivotally secured thereto, the end of the lever has a vertically adjustable rod which can move up or down to engage the end of the flush handle and to restrain the same from further movement in a first mode to cause a smaller selected amount of water to be flushed. In a second mode the lever is pivoted away from said bracket to unblock the path of the flush handle to cause the entire water content of the commode to flush.

8 Claims, 2 Drawing Figures

FLUSH CONTROL APPARATUS

BACKGROUND OF INVENTION

As evidenced by the present drought situation, there is a constant need to conserve water. As is well known in a typical home commode or toilet utility, many gallons of water are used. Each time the unit is flushed, one may dissipate between five to fifteen gallons of water. It is also known that for many purposes one does not have to release all the water in the tank to accommodate a sufficient flush. In view of such considerations, the prior art is replete with a number of patents which depict various devices to enable a consumer to use a lesser amount of water. Many of these devices employ valve mechanisms which are inserted in the water storage tank associated with a commode. These devices require the consumer to make complicated mechanical alterations in the water tank of the commode. An example of such a device is shown in U.S. Pat. No. 3,745,591 entitled TOILET FLUSHING MECHANISM, issued on May 5, 1971 to W. Girten. This device includes a lift rod which carries a bulb valve and has a lever on the outside of the tank which is connected to the lift rod. The device enables one to secure a limited water outflow and can be shifted when desired to secure a full outflow. U.S. Pat. No. 3,719,958 entitled WATER CLOSETS issued on Mar. 13, 1973 to J. R. Wilhelm shows a bypass connection which enables one to have an alternate water level in a toilet bowl. U.S. Pat. No. 4,122,564 entitled DUAL DISCHARGE VALVE UNIT issued on Oct. 31, 1978 to L. F. Addicks, et al. shows a discharge valve to be installed in the storage tank of a water closet to allow a full or partial flush. In a similar manner, U.S. Pat. No. 4,173,044 entitled DRAIN VALVE OPERATING DEVICE FOR A CISTERN OR FLUSH TOILET issued on Nov. 6, 1979 to E. Ota.

Essentially, all the devices as described above requires one to actually install apparatus within the water storage tank of the toilet or commode. Thus such devices have not been successful and have not been used as a consumer is not likely to make such an installation based on the difficulty and based on personal sanitary reasons. Certain of these devices described above can not be installed by a consumer and must be implemented by a manufacturer or by an experienced plumber and hence are expensive and completely unpractical. Other devices such as the device depicted in U.S. Pat. No. 3,719,957 issued on Mar. 13, 1973 to R. T. Riedel shows a device which controls the motion of the handle of the water storage tank of a toilet such that the handle can be moved only a sufficient distance to bring about the flushing. This device also has to be installed by removing the top of a water storage tank and is very limited in use as it does not lend itself to a dual operation. Still other devices such as disclosed in U.S. Pat. No. 4,145,774 entitled DUAL FLUSH APPARATUS FOR WATER CLOSETS issued Mar. 27, 1979 to D. E. Sullivan shows a bistable actuating handle which contains a complicated linkage and which requires a consumer to radically change the mechanism on a conventional water closet. It is an object of the present invention to provide a simple flush control apparatus which apparatus is easy to install by an unskilled consumer. The apparatus is extremely economical while enabling one to achieve a great deal of flexibility in determining the amount of water used during a flush.

The apparatus further allows one to flush the entire contents of the water storage tank in a simple and rapid manner. In this manner, minimum amount of water may be flushed during the majority of time while a maximum amount may be flushed only when necessary.

BRIEF DESCRIPTION OF THE PREFERRED EMBODIMENT

A flush control apparatus is adapted to be mounted beneath the flush handle associated with the water storage tank of a water closet or commode. The unit blocks the path of the handle in a first mode to allow a small amount of water to be used during a flush and unblocks the handle in a second mode to allow the full contents of the tank to be used during a flush. The apparatus includes a bracket to which a lever arm is pivotally secured with the arm containing an adjustable rod for moving in the vertical plane and when the arm is in a first position with respect to the bracket the rod blocks the flush handle path and when the lever is pivoted away from the bracket in a second position the flush handle is not blocked.

DETAILED DESCRIPTION OF THE FIGURES

Figure 1:
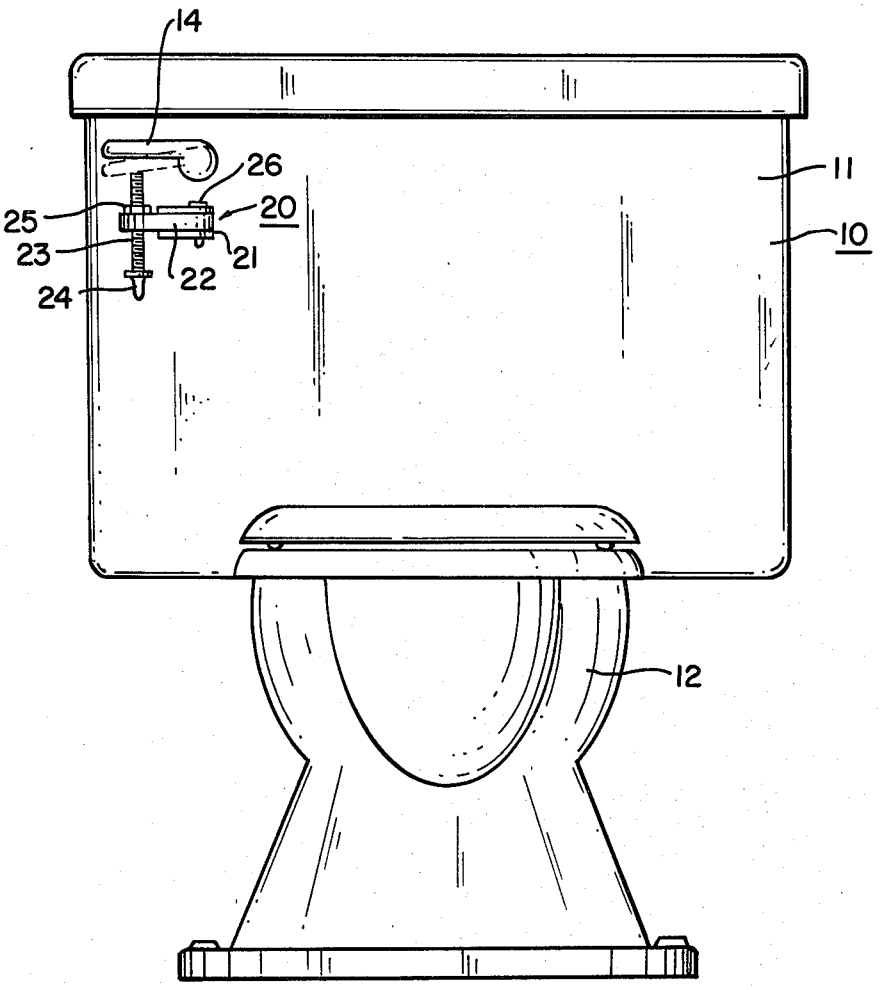
FIG. 1 is a front plan view of a commode employing the flush control apparatus according to this invention.

Referring to FIG. 1, there is shown a relatively conventional toilet or commode tank 10. The commode tank as is well known has a water storage tank positioned above the fixture 12. Associated with most commodes as 10 is a flush handle 14. As is well-known the handle 14 when depressed will cause a valve mechanism linked to the handle to discharge the entire water content of the storage tank 11. It is noted at the onset that the majority of commodes now employed in this country operate to open a flap or valve which discharges all the water in the tank when the handle 14 is depressed. Upon a refill cycle, the flap or valve is returned to its rest position so that the tank can fill. This mechanism is well-known and thoroughly described in the prior art. It is also known that for a slight movement of handle 14 in the downward direction, one can discharge a smaller amount of water without tripping the flap so that the entire contents of the tank is not dissipated. However, this is extremely difficult to do and requires a steady hand and concentration and hence is completely unacceptable.

Referring to FIG. 1 there is shown a flush control apparatus 20 according to this invention. The apparatus 20 basically consists of a bracket 21 which has a relatively flat back surface and has located thereon a double back adhesive. In this manner, the consumer by removing a treated paper can immediately emplace the control apparatus 20 in the position shown in FIG. 1 with the bracket 21 located beneath the pivot point portion of the handle 14.

Pivotally coupled to the bracket is a lever arm 22. The lever arm 22 contains an aperture at its outer end. An adjustable screw or rod 23 is threadedly located in the aperture and hence upon accessing a grip 24, the screw can be moved upwardly or downwardly and locked in place by means of a lock nut 25. As can be seen from FIG. 1, the top of the screw is positioned in the path of the handle 14. Hence, when the handle 14 is moved downwardly, this downward motion is limited by the position of the screw 23. In this manner, the consumer can cause any amount of water to be flushed according to the setting of the screw 23. For example, for one position a gallon of water may be used, as the screw is moved downwardly one may then flush two gallons and so on. The lever arm is pivotally connected to the bracket 21 by means of a pin 26 to form pivot point. Accordingly, the lever arm 22 can be grasped by the consumer and pulled outwardly to thereby clear the path of the handle 14. In this manner the consumer by doing so can cause the entire contents of the water storage tank to be flushed in a single motion. Upon doing so the lever arm can then be pushed or pivoted back to its original position to thereafter cause a lesser amount of water to be used.

Figure 2:
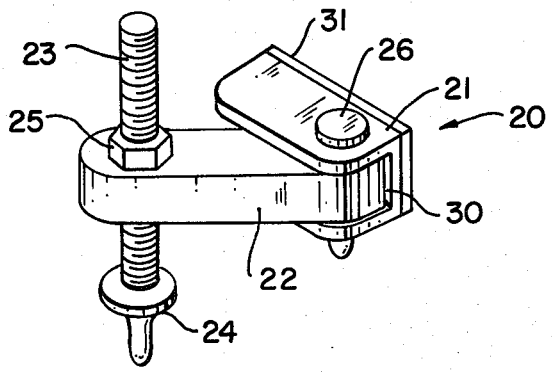
FIG. 2 is a perspective plan view of the flush control apparatus according to this invention.

Referring to FIG. 2, there is shown a perspective view of the flush control apparatus 20. The bracket 21 has top and bottom flanges which form a central channel 30. The back surface of the bracket 21 has secured thereto a plastic or elastomeric sheet impregnated with a strong adhesive. The surface is covered by a waxed paper or a removable protective layer which is peeled off by the consumer and the bracket is then pushed into position beneath the flush handle 14 where it is rigidly held by means of the adhesive.

Such adhesives as 31 are well-known in the art and are presently used for securing all sorts of implements to surfaces such as tile, porcelain and other surfaces which are of the exact nature as the surface of a water storage tank. The lever arm 22 is pivotally coupled to the bracket by means of the pivot point 26. Shown in FIG. 2 is the adjustable threaded member 23 with its adjusting tip 24 and the lock nut 25.

Thus as one can visualized from FIGS. 1 and 2, the lever arm can be pivoted outwardly to thereby remove the screw member 23 from the path of the flush handle 14 which operation can be accomplished in a rapid and easy manner.

The unit as depicted can be installed without the consumer ever accessing any portion of the water storage tank in regard to its internal construction as the consumer merely secures the unit 20 beneath the flush handle 14 as shown. This operation is simple, quick and assures a positive and reliable operation. The unit is extremely simple to make as it consists of very few parts which essentially are the bracket and its backing, the pin, the lever arm, the screw and the lock nut.

To accommodate most commodes presently available, the bracket is approximately 0.6" in width with a length of 1.3" with the lever arm 22 being about 2". The length of the threaded portion of the screw is about 2" with the tip about ½". These dimensions are sufficient for most existing commodes but other dimensions will suffice as well.

It can therefore be seen that the flush control apparatus according to this invention eliminates many problems of the prior art. It is extremely simple to install, easy to use and economical to manufacture. The device depicted will thus result in a substantial savings of water if employed in conjunction with conventional commodes.

Other variations and modifications will become apparent to those skilled in the art and all such modifications are deemed to be encompassed with the spirit and scope of the claims appended hereto.

I claim:

1. A flush control apparatus adapted for mounting beneath the flush handle associated with the water storage tank of a commode and for blocking the path of said handle to control the amount of water released in a first mode and for allowing said handle to be moved to completely flush the entire contents of said tank in a second mode, said apparatus comprising:

a bracket having a central channel and adapted to be mounted directly below said flush handle, a lever arm pivotally coupled to said bracket within said channel and extending relatively parallel to said flush handle, a vertically adjustable member adjustably positioned at the other end of said lever arm and positioned transverse thereto, whereby adjustment in the vertical plane limits the movement of said flush handle when coacting with said adjustable member to cause a controlled amount of water to be discharged from said tank during said first mode and when said lever arm is pivoted said adjusting means is cleared from the path of said handle to release the entire contents of said tank in said second mode.

2. The flush control apparatus according to claim 1 wherein said adjustable means includes a grasping member coupled thereto for moving said adjustable member during a vertical adjustment.

3. The flush control apparatus according to claim 1 wherein said bracket has a top flange and a bottom flange depending from a common base to form said channel therebetween, coaxial apertures in said flanges, said lever arm having a corresponding aperture coaxial with said apertures in said flanges and a pin mounted in said apertures to enable said lever to pivot away from said channel in said second mode.

4. The flush control apparatus according to claim 1 wherein said vertically adjustable member is a threaded cylindrical member threadedly coupled to said lever arm.

5. The flush control apparatus according to claim 1 further including locking means coupled to said adjustable member to lock the same in any selected one of a number of vertical positions.

6. The flush control apparatus according to claim 5 wherein said locking means is a lock nut.

7. The flush control apparatus according to claim 1 wherein the back of said bracket includes adhesive means for securing said bracket to the surface of said storage tank beneath said flush handle.

8. The flush control apparatus according to claim 7 wherein said adhesive means is a double backed adhesive for coupling said bracket to said surface of said storage tank.

* * * * *